US008025394B2

(12) United States Patent
Nishizaki et al.

(10) Patent No.: US 8,025,394 B2
(45) Date of Patent: Sep. 27, 2011

(54) IMAGE RECORDING APPARATUS

(75) Inventors: Masahiro Nishizaki, Iwakura (JP); Tadanobu Chikamoto, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 841 days.

(21) Appl. No.: 12/057,577

(22) Filed: Mar. 28, 2008

(65) Prior Publication Data

US 2008/0238977 A1 Oct. 2, 2008

(30) Foreign Application Priority Data

Mar. 29, 2007 (JP) ..... 2007-087373

(51) Int. Cl.
*B41J 2/01* (2006.01)
*B41J 29/38* (2006.01)

(52) U.S. Cl. ..... 347/107; 347/16; 347/104

(58) Field of Classification Search ..... 347/16, 347/101, 104, 107
See application file for complete search history.

(56) References Cited

U.S. PATENT DOCUMENTS

| | | | | |
|---|---|---|---|---|
| 6,309,064 | B1 * | 10/2001 | Tanno et al. | 347/104 |
| 7,052,126 | B2 | 5/2006 | Suzuki et al. | |
| 2003/0161668 | A1 * | 8/2003 | Hsieh et al. | 399/302 |
| 2006/0256148 | A1 | 11/2006 | Hirota et al. | |
| 2006/0279621 | A1 * | 12/2006 | Morohoshi | 347/104 |

FOREIGN PATENT DOCUMENTS

JP 2004-149284 A 5/2004

OTHER PUBLICATIONS

Office Action mailed Jan. 27, 2009, in corresponding Japanese Patent Application Serial No. 2007-087373 and partial English translation.

* cited by examiner

*Primary Examiner* — Daniel Petkovsek
(74) *Attorney, Agent, or Firm* — Banner & Witcoff, Ltd.

(57) ABSTRACT

An image recording apparatus includes a recording head that records an image on a recording medium, and a conveyor having an adhesive area and a charged area, that is charged by a charging unit. The adhesive area and the charged area are formed on the outer circumferential surface of the conveyor and convey the recording medium supported on the outer circumferential surface of the conveyor in a conveying direction. A medium feeder supplies the recording medium to the conveyor.

20 Claims, 8 Drawing Sheets

IMAGE RECORDING APPARATUS

BACKGROUND

1. Technical Field

The present application relates to image recording apparatuses that record images on recording media.

2. Description of the Related Art

Among image recording apparatuses that record images on recording media such as recording sheets, those including two rollers and an endless conveying belt that extends between the two rollers are well known The outer circumferential surface of the conveying belt serves as a conveying surface for conveying recording media. The conveying belt is an adhesive belt whose conveying surface is adhesive, and can reliably support recording sheets on the conveying surface thereof. With this, accuracy in conveying the recording sheets can be improved.

When recording sheets such as plain paper sheets having low rigidity and having few projections and depressions on the surfaces thereof are conveyed by the adhesive belt, the recording sheets are firmly adhered to the conveying surface, and cannot be easily separated from the conveying surface. Moreover, since dust particles generated by the recording sheets are firmly adhered to the conveying surface, the conveying surface needs to be vigorously washed such that the dust particles are removed. This leads to an increase in cost, and not only that, leads to a reduction in the lifetime of the adhesive belt. To solve these problems, a charged belt to which the recording sheets are adhered by electrostatic force can be used. However, since the adhesive force of the charged belt is small, it is difficult to reliably support recording sheets such as inkjet photo paper sheets having high rigidity and a tendency to deviate from a flat state, or recording sheets such as kraft paper sheets having projections and depressions formed on the surfaces thereof.

SUMMARY

It would be desirable to provide an image recording apparatus capable of appropriately conveying various types of recording media such as plain paper, inkjet paper, envelopes, coated paper, kraft paper, and inkjet photo paper.

An image recording apparatus according to one aspect includes an image recording apparatus includes a recording head that records an image on a recording medium, and a conveyor having an adhesive area and a charged area, that is charged by a charging unit. The adhesive area and the charged area are formed on the outer circumferential surface of the conveyor and convey the recording medium supported on the outer circumferential surface of the conveyor in a conveying direction. A medium feeder supplies the recording medium to the conveyor.

According to the above-described aspects, both the adhesive area and the charged area are formed on the conveying belt. Thus, various types of recording media can be appropriately conveyed by supporting the recording media at appropriate positions on the outer circumferential surface of the conveying belt depending on the properties of the recording media.

In the above-described image recording apparatus, the adhesive area and the charged area may be alternately disposed in a direction orthogonal to the conveying direction.

In certain embodiments, the conveying belt further may have one or more adhesive areas or charged areas.

In accordance with another aspect, an image recording apparatus includes a recording head that records an image on a recording medium, and a conveying belt extended between a first roller and a second roller and having a plurality of adhesive areas and a plurality of charged areas, that are charged by a charging unit. The adhesive areas and charged areas are formed on the outer circumferential surface of the conveying belt and convey the recording medium supported on the outer circumferential surface of the conveying belt in a conveying direction from the first roller to the second roller. The adhesive areas and the charged areas are alternately disposed in a direction orthogonal to the conveying direction. A medium feeder supplies the recording medium to the conveying belt.

In other embodiments, a gap may be provided at each boundary between the adhesive area and the charged area adjacent to each other. With this, dust particles generated by the recording medium are prevented from being adhered to the adhesive areas since the dust particles fall from the gaps.

In accordance with a further aspect, an image recording apparatus includes a recording head that records an image on a recording medium, and a conveying belt extended between a first roller and a second roller and having a plurality of adhesive areas and a plurality of charged areas, that are charged by a charging unit. The adhesive areas and charged areas are formed on the outer circumferential surface of the conveying belt and convey the recording medium supported on the outer circumferential surface of the conveying belt in a conveying direction from the first roller to the second roller. The adhesive areas and the charged areas are alternately disposed in the conveying direction. A medium feeder supplies the recording medium to the conveying belt such that a leading edge of the recording medium is supported on one of one of the adhesive areas and one of the charged areas.

In certain embodiments, the adhesive area and the charged area can be disposed adjacent to each other in the conveying direction.

In certain embodiments, the medium feeder may supply the recording medium such that the leading end of the recording medium is supported on the charged area. With this, the recording medium can be separated from the conveying belt more easily.

In certain embodiments, the recording head can be of the line-head type.

DESCRIPTION OF THE PREFERRED EMBODIMENTS

Particular embodiments will now be described with reference to the drawings.

First Embodiment

Figure 1:
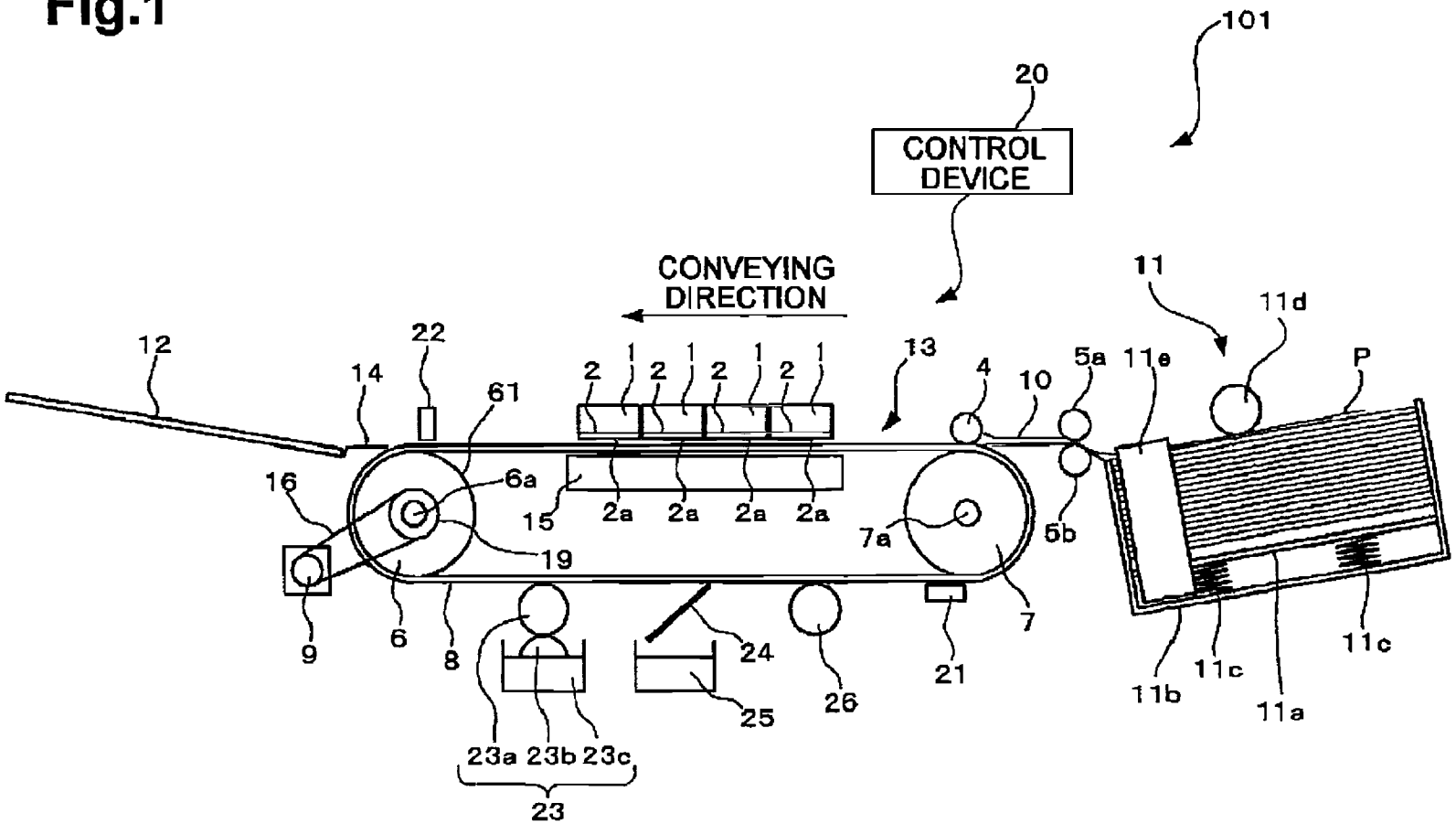
FIG. 1 is a schematic view of a first embodiment of an inkjet printer.
Figure 2:
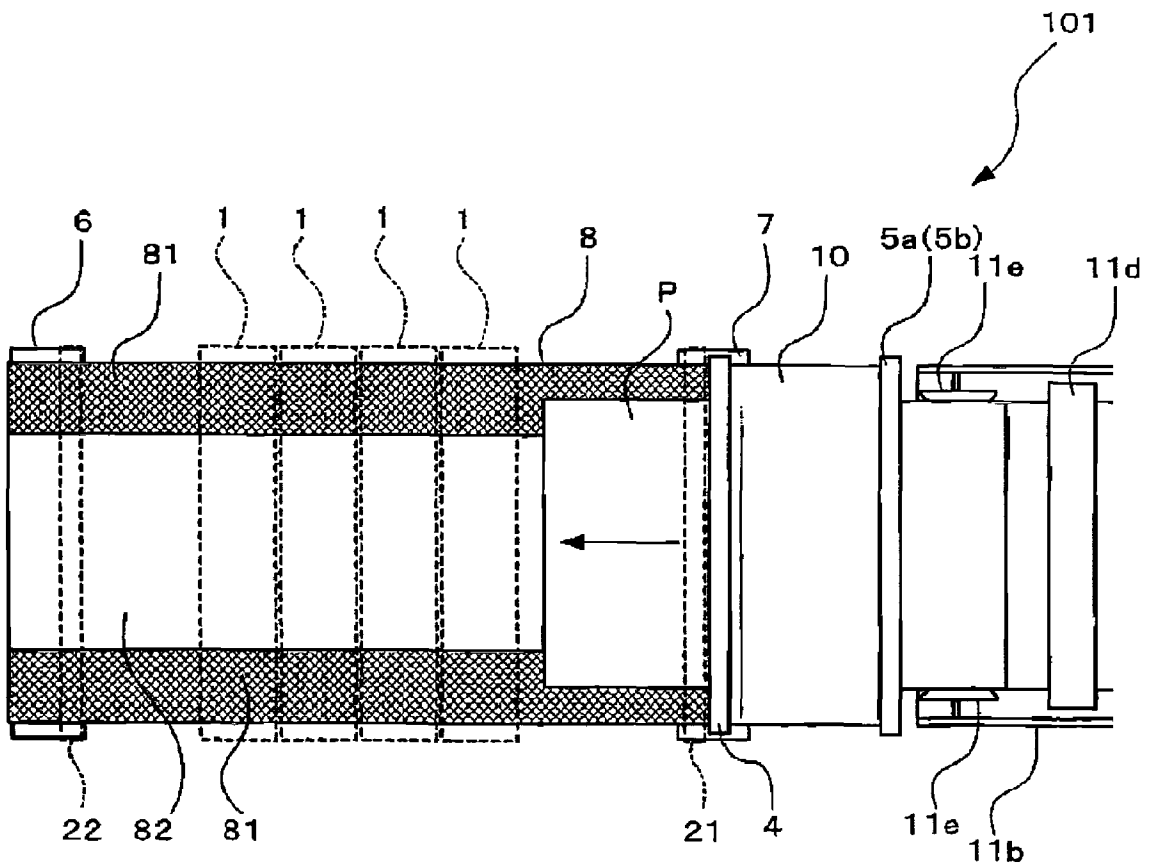
FIG. 2 is a plan view of the inkjet printer shown in FIG. 1.

FIG. 1 is a side view of a first embodiment of an inkjet printer serving as an image recording apparatus. FIG. 2 is a plan view of the inkjet printer shown in FIG. 1. As shown in FIGS. 1 and 2, an inkjet printer 101 may include a paper feeding device 11 that supplies normal-sized sheets P serving as recording media, a conveyor belt mechanism 13 that conveys the sheets P supplied by the paper feeding device 11 while supporting the sheets P on the outer circumferential surface of a conveying belt 8, four inkjet heads 1 that discharge ink droplets to the sheets P conveyed by the conveyor belt mechanism 13, and a paper output tray 12 that receives the sheets P after printing. In this embodiment, the sheets P have standardized rectangular shapes (A4 size, B5 size, and the like).

The inkjet printer 101 may have a paper conveying path, extending in a conveying direction from the paper feeding device 11 to the paper output tray 12 (from right to left in FIGS. 1 and 2), along which the sheets P are conveyed. A control device 20 may control operations of components in the inkjet printer 101.

The four inkjet heads 1 may each discharge ink droplets of a corresponding color (yellow, cyan, magenta, or black). That is, the inkjet printer 101 may be a color inkjet printer. The inkjet printer 101 may be of the line-head type including the inkjet heads (line heads) 1 fixed such that the longitudinal direction of the four inkjet heads 1 is orthogonal to the conveying direction. Head bodies 2 may be fixed to the lower portion of the corresponding inkjet heads 1. The head bodies 2 may have a slender rectangular shape extending in a direction orthogonal to the conveying direction. The bottom surfaces of the head bodies 2 may serve as discharge surfaces 2*a* having a plurality of nozzles for discharging ink droplets formed therein.

The paper feeding device 11 may include a paper tray 11*a*, a paper storage box 11*b*, a plurality of coil springs 11*c*, a pickup roller (medium supplying mechanism) 11*d*, and a pair of positioning plates (first positioning mechanism) 11*e*. The sheets P may be placed and stacked on the paper tray 11*a*. The paper tray 11*a* may be disposed inside the paper storage box 11*b*. The paper storage box 11*b* may have an opening in the top thereof that can accommodate the sheets P stacked on the paper tray 11*a*. The coil springs 11*c* may urge the paper tray 11*a* upward. The pickup roller 11*d* may be brought into contact with the top sheet P among the sheets P accommodated in the paper storage box 11*b* by the elastic force of the coil springs 11*c*. The positioning plates 11*e* may have substantially the same height as that of the paper storage box 11*b*, and may be disposed adjacent to the downstream end of the paper storage box 11*b* and at slightly inner positions away from the side walls of the paper storage box 11*b*. The inner surfaces of the positioning plates 11*e* may be in contact with both sides of the sheets P parallel to the conveying direction. As described below, the positioning plates 11*e* may be positioned such that both sides of the sheets P are disposed on adhesive areas 81.

The pickup roller 11*d* may feed the top sheet P to the left at a predetermined timing in response to commands issued by the control device 20. A pair of feed rollers 5*a* and 5*b* may be disposed at the left of the paper feeding device 11. The feed rollers 5*a* and 5*b* may further feed the sheet P from the paper feeding device 11 to the left. The sheet P fed to the left by the feed rollers 5*a* and 5*b* passes between a pair of guide plates 10 opposing each other in a vertical direction with a gap therebetween, and reaches the conveyor belt mechanism 13.

The conveyor belt mechanism 13 may include two belt rollers 6 and 7 having rotating shafts 6*a* and 7*a*, respectively, parallel to each other, the endless conveying belt 8 extending between the belt rollers 6 and 7, a platen 15, and a motor 9. The belt roller 6 may be disposed downstream of the belt roller 7 with the four inkjet heads 1 interposed therebetween.

The conveying belt 8 may have the adhesive areas 81 and a charged area 82 formed on the outer circumferential surface thereof. The adhesive areas 81 may be composed of a rubber material such as ethylene-propylene rubber (EPDM) having projections, depressions, and micropores formed on the surface thereof. The adhesive areas 81 may be adhesive, and the sheets P can be adhered thereto. The charged area 82 may be composed of a high-polymer material such as polycarbonate having high insulation resistance, and can be highly charged. The sheets P may be adhered to the charged area 82 by electrostatic force generated by charging the charged area 82 using a charger 21 disposed below the belt roller 7. The adhesive force generated by the electrostatic force may be removed by eliminating static charges using a static eliminator 22 disposed above the belt roller 6. The adhesive force of the adhesive areas 81 is larger than that of the charged area 82 after being charged. The adhesive areas 81 and the charged area 82 may extend in the conveying direction, with the charged area 82 being disposed between the two adhesive areas 81. That is, the adhesive areas 81 and the charged area 82 may be alternately disposed in the width direction of the conveying belt 8. The positioning plates 11*e* of the paper feeding device 11 position the sheets P such that both sides of the sheets P in the conveying direction may be disposed on the adhesive areas 81.

A nip roller 4 may be disposed above the belt roller 7. The nip roller 4 may press the sheet P fed by the feed rollers 5*a* and 5*b* and nipped between the nip roller 4 and the belt roller 7 against the outer circumferential surface of the conveying belt 8.

The motor 9 may drive the rotating shaft 6*a* of the belt roller 6 via an endless transmission belt 16 extending between an output shaft of the motor 9 and a transmission roller 19 coaxial with the belt roller 6. As a result, the belt roller 6 may rotate about the rotating shaft 6*a* in the counterclockwise direction as a driving roller. With this, the belt roller 7 may rotate about the rotating shaft 7*a* in the counterclockwise direction as a driven roller. The sheet P pressed against the outer circumferential surface of the conveying belt 8 by the nip roller 4 may be conveyed to the left from the belt roller 7 to the belt roller 6 while being supported on the upper flat portion of the outer circumferential surface, serving as a supporting surface, of the conveying belt 8 parallel to the discharge surfaces 2*a* in connection with the rotation of the belt rollers 6 and 7 in the counterclockwise direction. In this embodiment, the belt roller 6 disposed downstream of the belt roller 7 in the conveying direction may serve as the driving roller, and a stable tension can be applied to the supporting surface of the conveying belt 8. Thus, the supporting surface may be prevented from undulating.

The platen 15 may be disposed inside a space surrounded by the inner circumferential surface of the conveying belt 8, and the upper surface thereof may oppose the discharge surfaces 2*a* of the inkjet heads 1. The upper surface of the platen 15 may support the conveying belt 8 so that the conveying belt 8 is not warped downward in the area where the upper surface of the platen 15 opposes the supporting surface of the conveying belt 8 faces.

While the sheet P conveyed by the conveying belt 8 passes under the four head bodies 2, ink droplets of different colors may be discharged in sequence from the discharge surfaces 2*a* to the upper surface, i.e., surface to be printed, of the sheet P. As a result, desired color images may be formed on the upper surface of the sheet P.

The sheet P conveyed on the supporting surface of the conveying belt 8 may be separated from the supporting surface of the conveying belt 8 when the leading end of the sheet P runs on a separating plate 14 disposed at the left of the belt roller 6, and may be discharged from the conveyor belt mechanism 13. The sheet P discharged from the conveyor belt mechanism 13 may be received by the paper output tray 12.

A washing unit 23, a wiper 24, and a wiping roller 26 may be disposed below the conveying belt 8 in this order from the belt roller 6 toward the belt roller 7. These components may perform cleaning operations in which impurities including dust particles of the sheet P adhered to the outer circumferential surface of the conveying belt 8 may be removed. In some cases, the cleaning operations can be performed in response to commands issued by the control device 20 after the static charges of the charged area 82 are eliminated by the static eliminator 22. The washing unit 23 may include a washing roller 23*a* that is in contact with the outer circumferential surface of the conveying belt 8, a supply roller 23*b* that is in contact with the outer circumferential surface of the washing roller 23*a* so as to supply washing liquid to the washing roller 23*a*, and a washing-liquid reservoir 23*c* that contains the washing liquid and supplies the washing liquid to the supply roller 23*b*. The wiper 24 may be a plate member composed of an elastic material such as rubber, and may be inclined upward from the belt roller 6 to the belt roller 7 such that an end thereof adjacent to the belt roller 7 is in contact with the outer circumferential surface of the conveying belt 8. A waste-liquid reservoir 25 for accommodating waste liquid may be disposed below the other end of the wiper 24. The wiping roller 26 may be hygroscopic, and may be in contact with the outer circumferential surface of the conveying belt 8.

When the conveying belt 8 is driven, i.e., rotated in the counterclockwise direction, the washing roller 23*a* that is in contact with the conveying belt 8 may be rotated in the clockwise direction, and the supply roller 23*b* that is in contact with the washing roller 23*a* may be rotated in the counterclockwise direction. At this moment, the washing liquid stored in the washing-liquid reservoir 23*c* may be applied on the outer circumferential surface of the conveying belt 8 via the supply roller 23*b* and the washing roller 23*a*. Subsequently, the washing liquid applied on the outer circumferential surface of the conveying belt 8 may be scraped off by the wiper 24 together with the impurities adhered to the outer circumferential surface of the conveying belt 8. The washing liquid including the impurities scraped by the wiper 24 may run down to the waste-liquid reservoir 25 along the upper surface of the wiper 24. Finally, the outer circumferential surface of the conveying belt 8 from which the washing liquid is scraped by the wiper 24 may be wiped down by the wiping roller 26. In this manner, impurities such as dust particles of the sheet P adhered to the outer circumferential surface of the conveying belt may be removed.

According to the above-described embodiment, the charged area 82 may be disposed between the two adhesive areas 81, and the positioning plates 11*e* of the paper feeding device 11 position the sheets P such that both sides of the sheets P in the conveying direction are supported by the adhesive areas 81. With this, the sheets P may be prevented from floating. Since the adhesive force in this structure is reduced as compared with the case where the sheets P are conveyed while the entire areas of the sheets P are adhered to only the adhesive areas 81, the sheets P can be separated from the conveying belt 8 more easily. Moreover, since the amount of dust particles generated by the recoding sheets and adhered to the adhesive areas 81 is reduced as compared with the case where the sheets P are conveyed on only the adhesive areas 81, the lifetime of the belt can be increased.

Modification of First Embodiment

Figure 3:
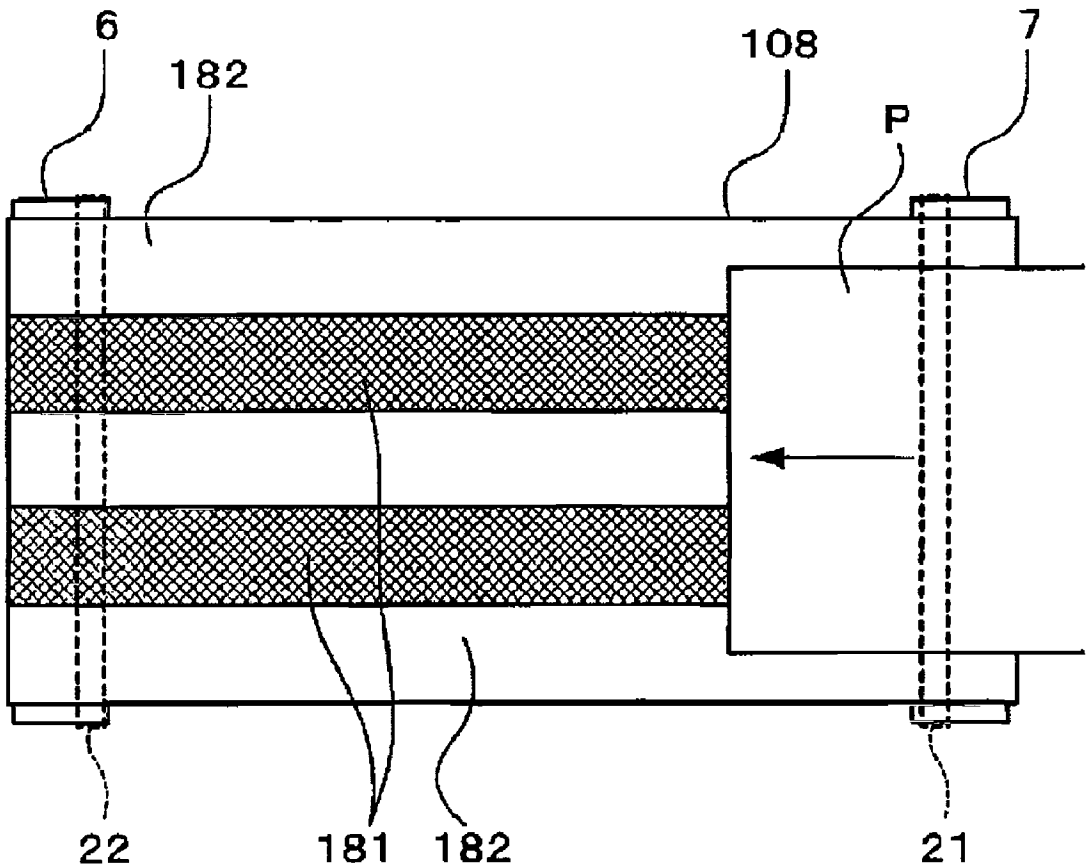
FIG. 3 is a plan view of a modification of the inkjet printer shown in FIG. 1.

In the above-described embodiment, the conveying belt may have one charged area and two adhesive areas. However, the number of the charged area and the adhesive area is not limited, and the conveying belt may have at least one charged area and at least one adhesive area. As shown in FIG. 3, for example, two adhesive areas 181 and three charged areas 182 can be alternately formed on the outer circumferential surface of a conveying belt 108 in the width direction of the conveying belt 108. When the conveying belt 108 has a plurality of adhesive areas 181 and a plurality of charged areas 182 in this manner, sheets P whose size varies in the width direction of the conveying belt 108 can be supported.

Second Embodiment

Figure 4:
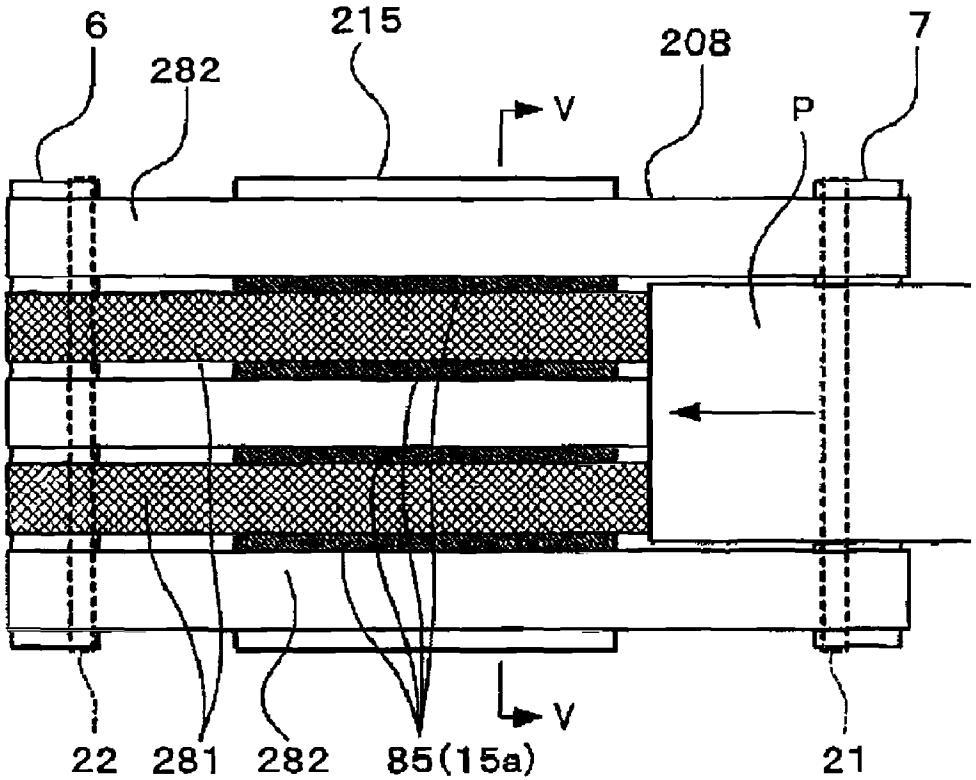
FIG. 4 is a plan view of a second embodiment of an inkjet printer.
Figure 5:
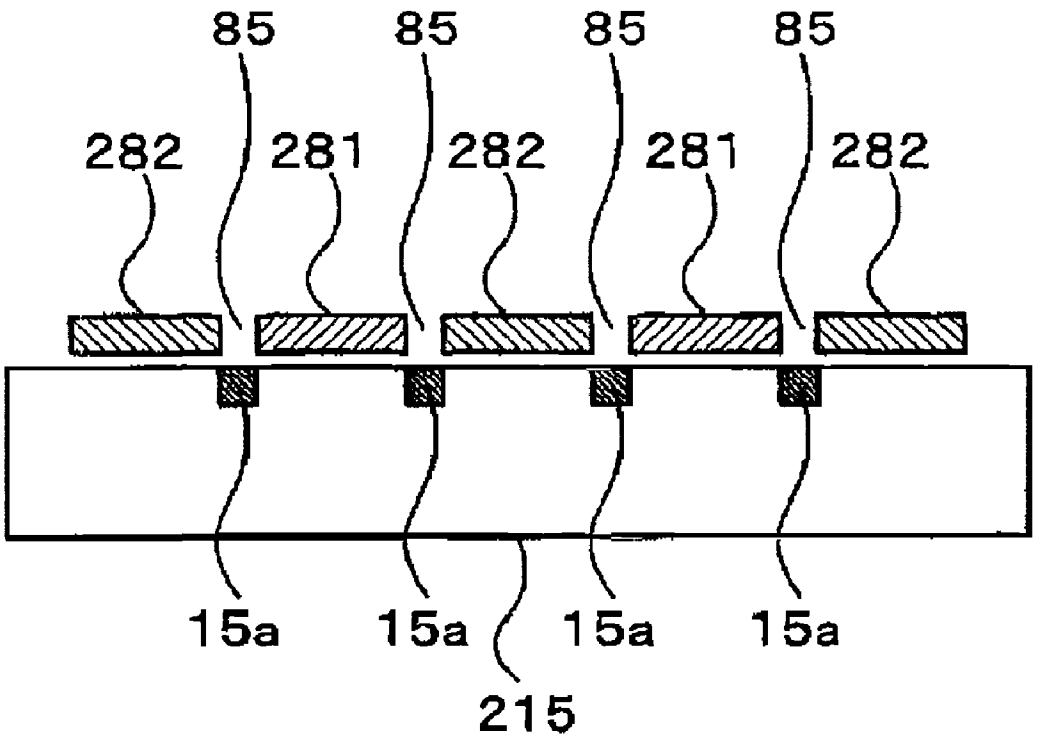
FIG. 5 is a cross-sectional view taken along line V-V in FIG. 4.

Next, a second embodiment will be described with reference to FIGS. 4 and 5. FIG. 4 is a plan view of an inkjet printer according to this embodiment. FIG. 5 is a cross-sectional view taken along line V-V in FIG. 4. The same reference numerals are used for components substantially the same as those in the first embodiment, and the descriptions thereof are omitted. As shown in FIG. 4, two adhesive areas 281 and three charged areas 282 may be formed on the outer circumferential surface of a conveying belt 208. The adhesive areas 281 and the charged areas 282 extend in the conveying direction, and are alternately disposed in the width direction of the conveying belt 208. Furthermore, the adhesive areas 281 and the charged areas 282 may be separated from each other in the width direction of the conveying belt 208 such that gaps 85 are provided between the adhesive areas 281 and the charged areas 282. Positioning plates (second positioning mechanism) lie of a paper feeding device 11 may position sheets P such that both sides of the sheets P are disposed over the gaps 85.

As shown in FIG. 5, four grooves 15*a* opposing the four gaps 85 and extending in the conveying direction may be formed on the upper surface of a platen 215 disposed inside a space surrounded by the inner circumferential surface of the conveying belt 208, and spongy ink absorbing members are fitted into the grooves 15*a*. With this structure, ink droplets discharged to areas outside both sides of the sheets P during frameless recording, in which inkjet heads 1 discharge ink droplets to the entire areas of the sheets P, may fall from the gaps 85 and can be absorbed into the ink absorbing members fitted in the grooves 15*a*.

According to the above-described embodiment, dust particles generated by the sheets P may fall from the gaps 85 formed between the adhesive areas 281 and the charged areas 282. Thus, the dust particles may be prevented from adhering to the adhesive areas 281.

Furthermore, the positioning plates 11*e* of the paper feeding device 11 may position the sheets P such that both sides of the sheets P are disposed over the gaps 85. Accordingly, ink droplets discharged to areas outside both sides of the sheets P during frameless printing may fall from the gaps 85, and can be absorbed into the ink absorbing members fitted in the grooves 15*a* of the platen 215. Thus, ink is not adhered to the conveying belt 208.

Third Embodiment

Figure 6:
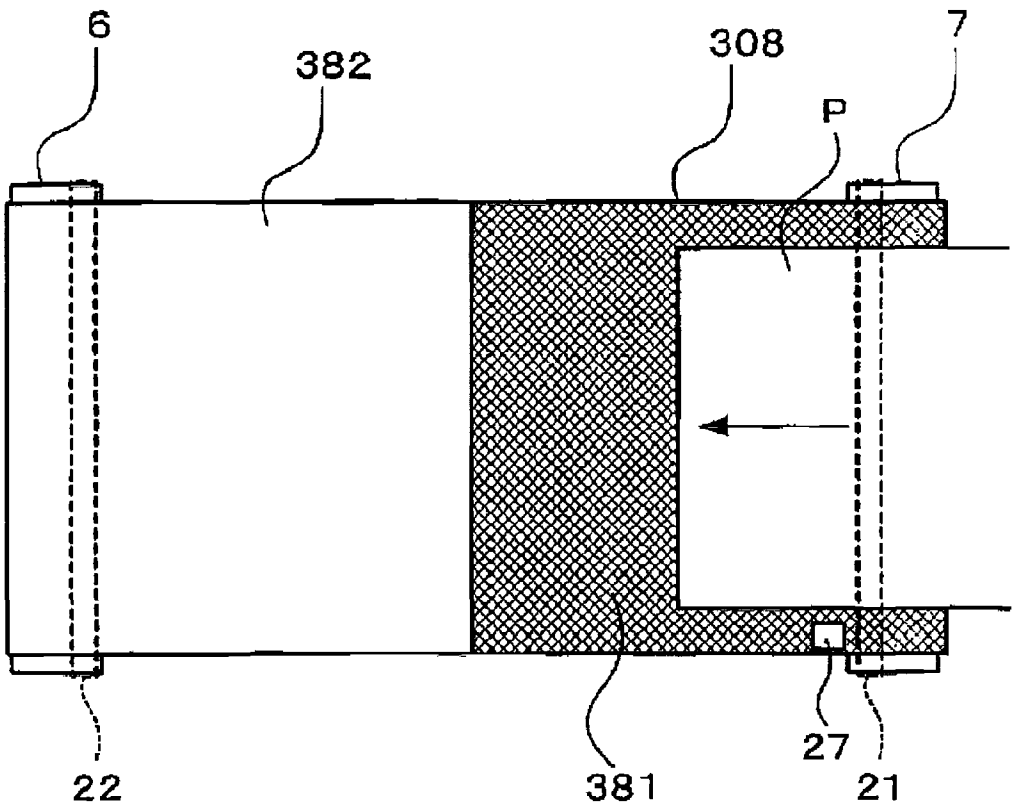
FIG. 6 is a plan view of a third embodiment of an inkjet printer.

Next, a third embodiment will be described with reference to FIG. 6. FIG. 6 is a plan view of an inkjet printer according to this embodiment. The same reference numerals are used for components substantially the same as those in the first embodiment, and the descriptions thereof are omitted. As shown in FIG. 6, an adhesive area 381 and a charged area 382 may be formed on the outer circumferential surface of a conveying belt 308. The adhesive area 381 and the charged area 382 nay extend in the entire area in the width direction of the conveying belt 308, and may be disposed adjacent to each other in the conveying direction. Furthermore, the length of the adhesive area 381 and that of the charged area 382 in the conveying direction may be larger than that of sheets P in the conveying direction.

An optical sensor 27 for detecting the positions of the adhesive area 381 and the charged area 382 may be disposed in the vicinity of a belt roller 7. Since the reflectivity of the adhesive area 381 and that of the charged area 382 may differ from each other, the optical sensor 27 can detect the positions of the adhesive area 381 and the charged area 382 by detecting the difference between the reflectivities. A control device (first medium-supply control unit) 20 may control the drive of a pickup roller 11*d* (see FIGS. 1 and 2) such that the entire areas of the sheets P can be disposed on the adhesive area 381 or the charged area 382 on the basis of the types of the sheets P and detection results produced by the optical sensor 27. Specifically, when the sheets P are plain paper sheets, the control device 20 can drive the pickup roller 11*d* such that the entire areas of the sheets P are disposed on the charged area 382 having an adhesive force smaller than that of the adhesive area 381. On the other hand, when the sheets P are, for example, inkjet photo paper sheets having high rigidity and a tendency to deviate from a flat state, or kraft paper sheets having projections and depressions formed on the surfaces thereof, the control device 20 may drive the pickup roller 11*d* such that the entire areas of the sheets P may be disposed on the adhesive area 381 having larger adhesive force.

According to the above-described embodiment, various types of sheets P can be appropriately conveyed by placing the sheets P on the adhesive area 381 or the charged area 382 depending on the properties of the sheets P.

Modification of Third Embodiment

Figure 7:
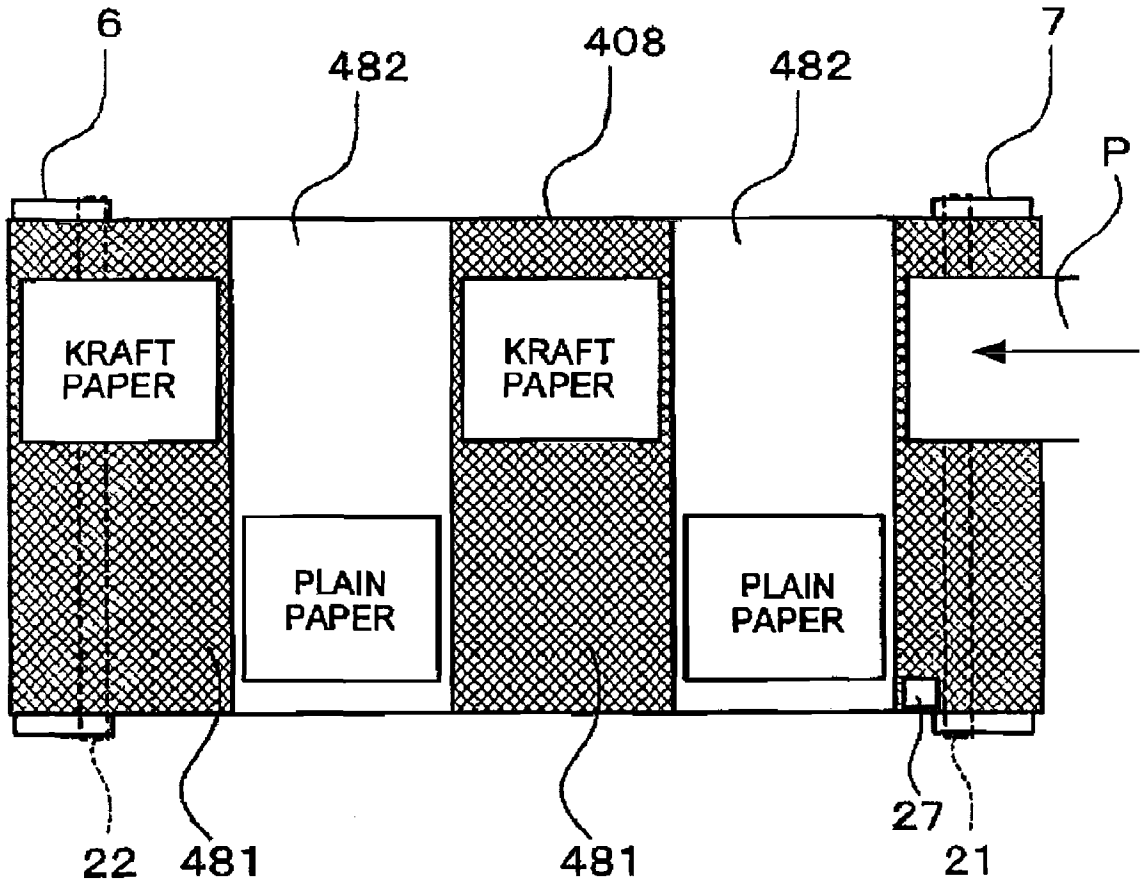
FIG. 7 is a plan view of a modification of the inkjet printer shown in FIG. 6.

The structure of a paper feeding mechanism can be provided such that two types of sheets P can be supplied in parallel to a conveying belt 408. That is, as shown in FIG. 7, a control device 20 can drive a pickup roller such that plain paper sheets are disposed on charged areas 482 and kraft paper sheets are disposed on adhesive areas 481 in an alternate manner.

In this manner, different types of sheets P can be conveyed on the adhesive areas 481 and the charged areas 482 in an alternate manner so that the printing efficiency can be improved.

Fourth Embodiment

Figure 8:
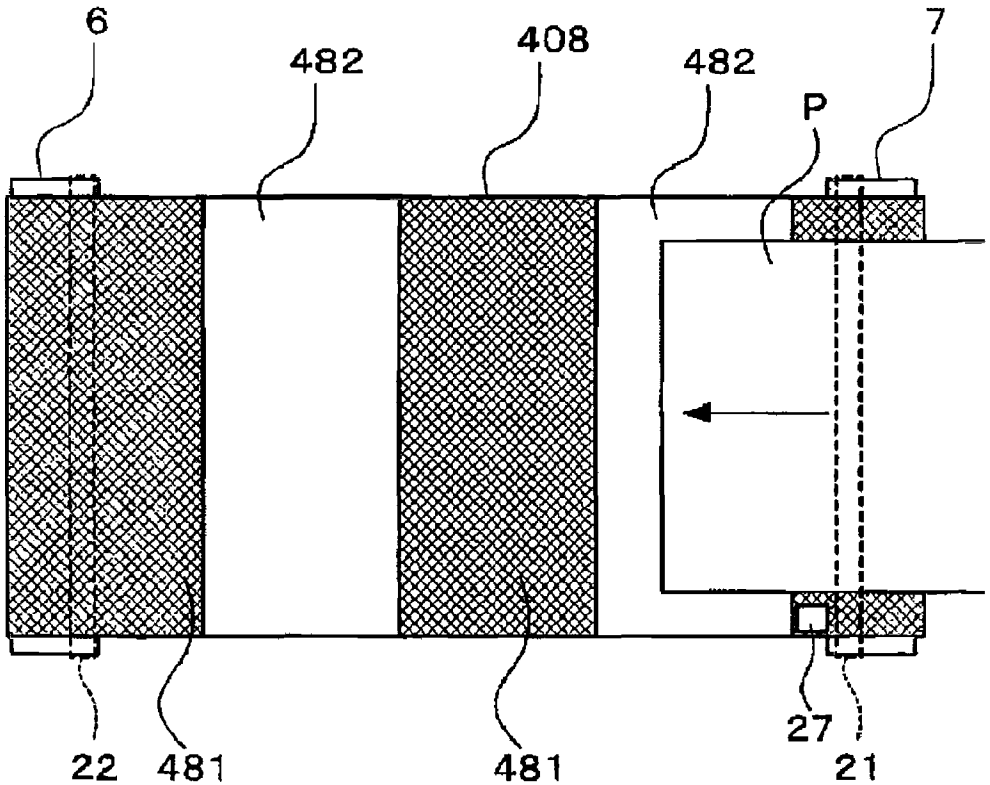
FIG. 8 is a plan view of a fourth embodiment of an inkjet printer.

Next, a fourth embodiment will be described with reference to FIG. 8. FIG. 8 is a plan view of an inkjet printer according to this embodiment. The same reference numerals are used for components substantially the same as those in the first embodiment, and the descriptions thereof are omitted. As shown in FIG. 8, adhesive areas 481 and charged areas 482 may be formed on the outer circumferential surface of a conveying belt 408. The adhesive areas 481 and the charged areas 482 may extend in the entire area in the width direction of the conveying belt 408, and may be alternately disposed in the conveying direction.

An optical sensor 27 for detecting the positions of the adhesive areas 481 and the charged areas 482 may be disposed downstream of a belt roller 7. A control device (second medium-supply control unit) 20 may control the drive of a pickup roller 11*d* (see FIGS. 1 and 2) such that the leading ends of sheets P may be disposed on the charged areas 482 and the other portions of the sheets P may be disposed on the adhesive areas 481 on the basis of detection results produced by the optical sensor 27.

According to the above-described embodiment, the leading ends of the sheets P may be disposed on the charged areas 482, and the other portions of the sheets P may be disposed on the adhesive areas 481. Thus, the portions of the sheets P other than the leading ends thereof can be reliably supported by the adhesive areas 481, and at the same time, the sheets P can be easily separated from the charged areas 482 at the leading ends of the sheets P.

The embodiments discussed above were described as above while referring to the drawings. However, the present patent is not limited to the above-described embodiments, and various modifications are possible.

In the first to fourth embodiments, the sheets P are adhered to the adhesive areas 81, 181, 281, 381, and 481 using the adhesive force of the adhesive areas. Alternatively, through-holes can be formed in the adhesive areas, and an air-suction unit can be incorporated into the platen such that an air-suction function is added to the adhesive areas. With this, the adhesive force with which the sheets P are adhered to the adhesive areas can be adjusted, and the number of types of sheets P that can be appropriately conveyed can be increased.

In the above-described embodiments, the present patent is applied to the inkjet printer 101 including the inkjet heads 1 of the line-head type. However, the present patent is also applicable to image recording apparatuses including recording heads of other types, for example, inkjet heads of the serial-head type and thermal heads.

What is claimed is:

1. An image recording apparatus comprising:

a recording head that records an image on a recording medium;

a conveyor having an adhesive area and a charged area, that is charged by a charging unit, the adhesive area and the charged area being formed on the outer circumferential surface of the conveyor and conveying the recording medium supported on the outer circumferential surface of the conveyor in a conveying direction, each of the adhesive area and the charged area extending one of across an entirety of the conveyor in a direction orthogonal to the conveying direction and annularly around an entire outer surface of the conveyor; and a medium feeder that supplies the recording medium to the conveyor.

2. The image recording apparatus according to claim 1, wherein the adhesive area and the charged area are alternately disposed in a direction orthogonal to the conveying direction.

3. The image recording apparatus according to claim 2, wherein the conveyor further comprises at least one of an additional adhesive area and an additional charged area.

4. The image recording apparatus according to claim 3,wherein the conveyor further comprises at least one additional adhesive area; and the medium feeder supplies the recording medium to the conveyor such that each side of the recording medium extending in the conveying direction is supported on one of the adhesive areas.

5. The image recording apparatus according to claim 3, wherein each adhesive area is separated from each adjacent charged area by a gap.

6. The image recording apparatus according to claim 5, wherein the medium feeder supplies the recording medium to the conveyor such that each side of the recording medium extending in the conveying direction is disposed over one of the gaps.

7. The image recording apparatus according to claim 1, wherein the adhesive area and the charged area are disposed adjacent to each other in the conveying direction.

8. The image recording apparatus according to claim 7, further comprising:

a detecting unit that detects positions of the adhesive area and the charged area;

wherein the medium feeder supplies the recording medium to the conveyor such that an entire area of the recording medium is supported by one of the adhesive area and the charged area on the basis of detection results produced by the detecting unit.

9. The image recording apparatus according to claim 7, further comprising:

a detecting unit that detects positions of the adhesive area and the charged area;

wherein the medium feeder supplies the recording medium to the conveyor such that the recording medium is supported by both the adhesive area and the charged area on the basis of detection results produced by the detecting unit.

10. The image recording apparatus according to claim 9, wherein the medium feeder supplies the recording medium to the conveyor such that a leading end of the recording medium is supported by the charged area.

11. The image recording apparatus according to claim 1, wherein the recording head is of the line-head type.

12. The image recording apparatus according to claim 1, wherein the conveyor further comprises at least one additional adhesive area and at least one additional charged area.

13. The image recording apparatus according to claim 1, further comprising a detecting unit that detects positions of the adhesive area and the charged area;

wherein the medium feeder supplies the recording medium to the conveyor such that an entire area of the recording medium is supported by one of the adhesive area and the charged area on the basis of detection results produced by the detecting unit.

14. The image recording apparatus according to claim 1, wherein the adhesive area and the charged area are alternately disposed in the conveying direction; and the medium feeder supplies the recording medium to the conveyor such that a leading edge of the recording medium is supported on one of the adhesive area and the charged area.

15. An image recording apparatus comprising:

a recording head that records an image on a recording medium;

a conveying belt extended between a first roller and a second roller, having a plurality of adhesive areas and a plurality of charged areas, that are charged by a charging unit, the adhesive areas and charged areas being formed on the outer circumferential surface of the conveying belt and conveying the recording medium supported on the outer circumferential surface of the conveying belt in a conveying direction from the first roller to the second roller, the adhesive areas and the charged areas being alternately disposed in a direction orthogonal to the conveying direction and extending annularly around an entire outer surface of the conveyor in the conveying direction; and a medium feeder that supplies the recording medium to the conveying belt.

16. The image recording apparatus according to claim 15, wherein the medium feeder supplies the recording medium to the conveying belt such that each side of the recording medium extending in the conveying direction is supported on one of the adhesive areas.

17. The image recording apparatus according to claim 15, wherein each adhesive area is separated from each adjacent charged area by a gap; and the medium feeder supplies the recording medium to the conveying belt such that each side of the recording medium extending in the conveying direction is disposed over one of the gaps.

18. The image recording apparatus according to claim 17, further comprising:

a platen positioned beneath a portion of the conveying belt that supports the recording medium, the platen having a plurality of grooves formed in its upper surface, each groove being positioned below one of the gaps; and a plurality of ink absorbing members, each ink absorbing member being received in one of the grooves.

19. An image recording apparatus comprising:

a recording head that records an image on a recording medium;

a conveying belt extended between a first roller and a second roller, having a plurality of adhesive areas and a plurality of charged areas, that are charged by a charging unit, the adhesive areas and charged areas being formed on the outer circumferential surface of the conveying belt and conveying the recording medium supported on the outer circumferential surface of the conveying belt in a conveying direction from the first roller to the second roller, the adhesive areas and the charged areas being alternately disposed in the conveying direction and extending across an entirety of the conveying belt in a direction orthogonal to the conveying direction; and a medium feeder that supplies the recording medium to the conveying belt such that a leading edge of the recording medium is supported on one of one of the adhesive areas and one of the charged areas.

20. The image recording apparatus according to claim 19, further comprising a detecting unit that detects positions of the adhesive areas and the charged areas;

wherein the medium feeder supplies the recording medium to the conveying belt such that an entire area of the recording medium is supported by one of one of the adhesive areas and one of the charged areas on the basis of detection results produced by the detecting unit.

* * * * *